US008662965B2

(12) United States Patent
Huang et al.

(10) Patent No.: US 8,662,965 B2
(45) Date of Patent: Mar. 4, 2014

(54) COUNTER-ROTATING POLISHER

(75) Inventors: Jianchu Huang, Zhejiang (CN); Kewei Wang, Zhejiang (CN); Kunyuan Chu, Zhejiang (CN); Xiaoping Xu, Zhejiang (CN); Ligang Zhu, Zhejiang (CN)

(73) Assignee: Hammer Electric Power Tools Co., Ltd., Zhuji, Zhejiang Province (CN)

( * ) Notice: Subject to any disclaimer, the term of this patent is extended or adjusted under 35 U.S.C. 154(b) by 562 days.

(21) Appl. No.: 12/946,826

(22) Filed: Nov. 15, 2010

(65) Prior Publication Data

US 2012/0088442 A1 Apr. 12, 2012

(30) Foreign Application Priority Data

Oct. 8, 2010 (CN) ..... 2010 1 0290569

(51) Int. Cl.
*B24B 23/00* (2006.01)

(52) U.S. Cl.
USPC ..... 451/359; 451/353; 451/344

(58) Field of Classification Search
USPC ..... 451/344, 353, 357, 359
See application file for complete search history.

(56) References Cited

U.S. PATENT DOCUMENTS

| | | | | |
|---|---|---|---|---|
| 4,158,246 | A * | 6/1979 | Meadows et al. | 15/28 |
| 6,032,313 | A * | 3/2000 | Tsang | 15/22.1 |
| 6,752,702 | B1 * | 6/2004 | Thompson et al. | 451/177 |
| 7,563,156 | B2 * | 7/2009 | Anderson | 451/353 |
| 7,707,674 | B2 * | 5/2010 | Schonewille et al. | 15/28 |
| 7,828,632 | B2 * | 11/2010 | Palushi | 451/350 |
| 2003/0040265 | A1 * | 2/2003 | Palushi | 451/350 |
| 2010/0223874 | A1 * | 9/2010 | Young | 52/318 |

* cited by examiner

*Primary Examiner* — Eileen P. Morgan

(57) ABSTRACT

A counter-rotating polisher includes: an enclosure, an electric motor, a polishing arrangement and a counter-rotating arrangement. The electric motor is fixed to the enclosure and includes a driving axle. The polishing arrangement includes two polishing device. The polishing devices respectively include a fixed tray and a polishing material that are fixedly connected to an outside of the fixed tray. The fixed tray is perpendicular to the driving axle. The counter-rotating arrangement includes a first driving wheel, a second driving wheel and a change-direction wheel. The first driving wheel is connected to the driving axle and driven by the driving axle. The second driving wheel is fixedly connected to the second fixed tray. The change-direction wheel is connected to the first driving wheel and the second driving wheel. The driving axle rotates the first polishing material positively. The change-direction wheel reversely transmits the rotation to the second driving wheel.

20 Claims, 5 Drawing Sheets

COUNTER-ROTATING POLISHER

BACKGROUND OF THE PRESENT INVENTION

1. Field of Invention

The present invention relates to a polisher, and more particularly to a counter-rotating polisher.

2. Description of Related Arts

Polishers are used in many industries and occasions. Nowadays, a tray of a conventional polisher rotates towards a single direction, this kind of structure does not only have an inferior effect, but also runs unsteadily. Because of a reacting force of the polished object, the polisher is always under a single direction force in operating, so a person is needed to fix a position of the polisher, especially a long time operating will bring the person hands fatigue.

SUMMARY OF THE PRESENT INVENTION

A main object of the present invention is to provide a counter-rotating polisher which counter-rotating polishes at the same time, the reacting forces of the polishing object are counteracted, and does not need to fix specially.

Another object of the present invention is to provide a counter-rotating polisher which counter-rotating polishes at the same time, the polishing objects are polished in different directions, so that polishing effect is increased as comparing to the conventional polisher.

Another object of the present invention is to provide a counter-rotating polisher, the counter-rotating polisher is used in hands and provided for a long time operating, and the hands fatigue is reduced.

Another object of the present invention is to provide a counter-rotating polisher, the counter-rotating polisher has a long working life, the using effect is not declined by a longer working time.

Another object of the present invention is to provide a counter-rotating polisher, the counter-rotating polisher is simple in structure, cheap in costs and is suited to generalize in a large scale.

Accordingly, in order to accomplish the above objects, the present invention provides a counter-rotating polisher, comprising:

an enclosure;

an electric motor, comprising a driving axle, and fixed inside the enclosure;

a polishing arrangement, driven by the electric motor, comprising: a first polishing device, comprising a first fixed tray perpendicular to the driving axle and a first polishing material fixedly connected to an outer wall of the first fixed tray, and a second polishing device, comprising a second fixed tray perpendicular to the driving axle and a second polishing material fixedly connected to an outer wall of the second fixed tray, wherein a polishing surface of the first polishing material and a polishing surface of second polishing material are on a same plane and rotate coaxially and oppositely; and a counter-rotating arrangement, comprising a first driving wheel connected to the driving axle and driven by the driving axle, a second driving wheel fixedly connected to the second fixed tray, and a change-direction wheel connected to the first driving wheel and the second driving wheel, wherein the first fixed tray is connected to the driving axle and driven by the driving axle to rotate the first polishing material positively, the change-direction wheel reversely transmits a rotation of the first driving wheel to the second driving wheel to rotate the second polishing material reversely.

With the foregoing structure, the first polishing material and the second polishing material polish oppositely at the same time, the polishing effect is increased, the reacting forces of the polishing object are counteracted, the working life of the counter-rotating polisher is prolonged.

These and other objectives, features, and advantages of the present invention will become apparent from the following detailed description, the accompanying drawings, and the appended claims.

DETAILED DESCRIPTION OF THE PREFERRED EMBODIMENT

Figure 1:
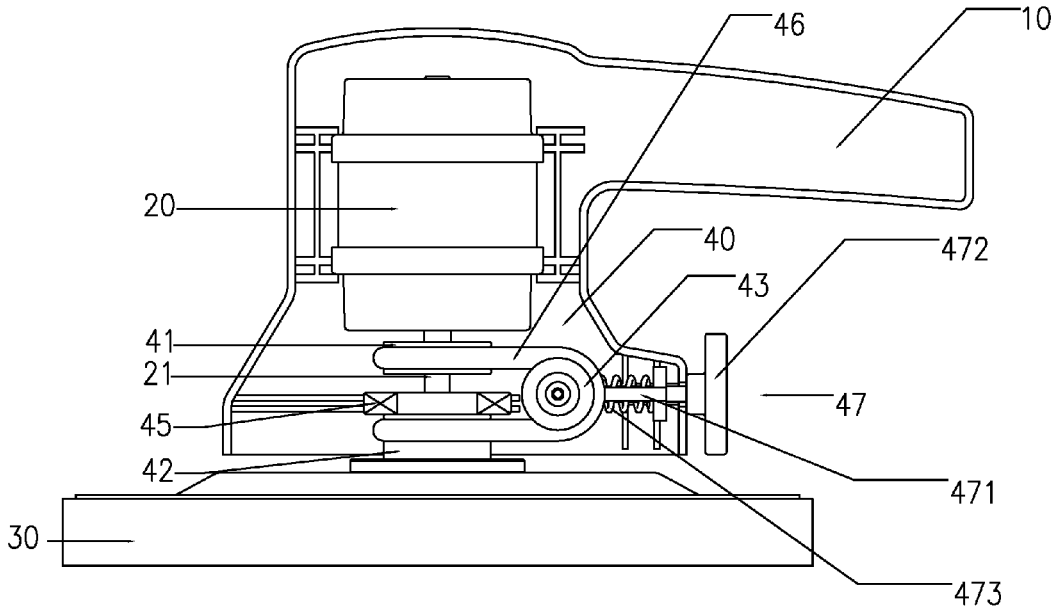
FIG. 1 is a side view of an inner structure of a counter-rotating polisher according to the present invention.
Figure 2:
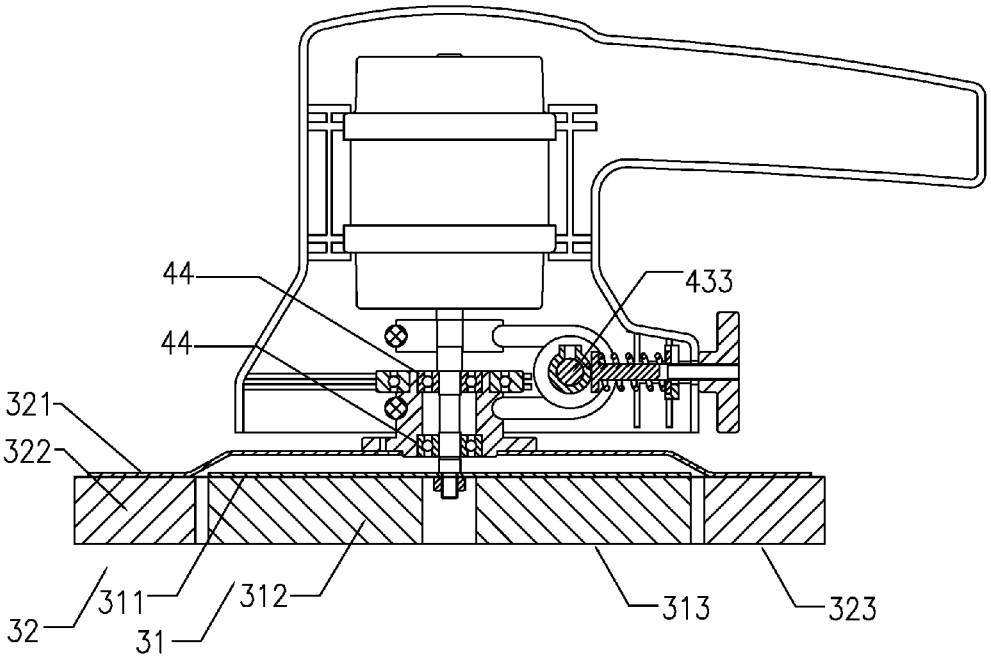
FIG. 2 is a side sectional view of the counter-rotating polisher according to the present invention.

Referring to FIG. 1 to FIG. 10 of the drawings, the present invention is a counter-rotating polisher, comprising: an enclosure 10, an electric motor 20, a polishing arrangement 30 and a counter-rotating arrangement 40.

The electric motor 20 is fixed to the enclosure 10, the electric motor 20 comprises a driving axle 21.

The polishing arrangement 30 comprises a first polishing device 31 and a second polishing device 32. The first polishing device 31 comprises a first fixed tray 311 and a first polishing material 312. The first polishing material 312 is fixedly connected to an outer side of the first fixed tray 311. The first fixed tray 311 is perpendicular to the driving axle 21. The second polishing device 32 comprises a second fixed tray 321, and a second polishing material 322 fixedly connected to an outer side of the second fixed tray 321. The second fixed tray 321 is perpendicular to the driving axle 21. A polishing surface 313 of the first polishing material 312 and a polishing surface 323 of the second polishing material 322 are in a same plane and rotate coaxially and oppositely.

The counter-rotating arrangement 40 comprises a first driving wheel 41, a second driving wheel 42, and a change-direction wheel 43. The first driving wheel 41 is connected to the driving axle 21 and driven by the driving axle 21. The second driving wheel 42 is fixedly connected to the second fixed tray 321. The change-direction wheel 43 is connected to the first driving wheel 41 and the second driving wheel 42. The first fixed tray 311 is connected to the driving axle 21 and driven by the driving axle 21 to rotate the first polishing material 312 positively. The change-direction wheel 43 reversely transmits the rotation of the first driving wheel 41 to the second driving wheel 42 to rotate the second polishing material 322 reversely.

The reacting forces of the polished object created in polishing are counteracted through the opposite rotation of the first polishing material 312 and the second polishing material 322, so when one operates the counter-rotating polisher of the present invention, it is no need to fix the counter-rotating polisher specially, especially for operating by hands, it's not easy to bring a person hands fatigue, so as to increase the work efficiency.

According to a preferred embodiment of the present invention, the counter-rotating arrangement 40 further comprises at least one bearing 44. The first fixed tray 311 is fixed directly to the driving axle 21, the bearing 44 is sleeved on the driving axle 21, the second driving wheel 42 is connected to the bearing 44, in such a manner that the first fixed tray 311 and the second fixed tray 312 rotate coaxially and oppositely. With the foregoing structure, the driving axle 21 directly drives the first fixed tray 311 to rotate positively, and because of the act of the bearing 44, the second driving wheel 42 does not rotate directly along with the driving axle 21. At the same time, the driving axle 21 drives the first driving wheel 41 to rotate, the change-direction wheel 43 is driven by the driving axle 21 and acts on the second driving wheel 42 to rotate the second driving wheel 42 oppositely to the first driving wheel 41, so that the second fixed tray 321 and the first fixed tray 311 are driven to rotate coaxially and oppositely.

Concretely, the counter-rotating arrangement 40 further comprises a reinforced bearing 45, which is mounted between the second driving wheel 42 and the enclosure 10 to make the second driving wheel 42 run smoothly and increase a rigidity of the driving axle 21 of the electric motor 20.

Figure 3:
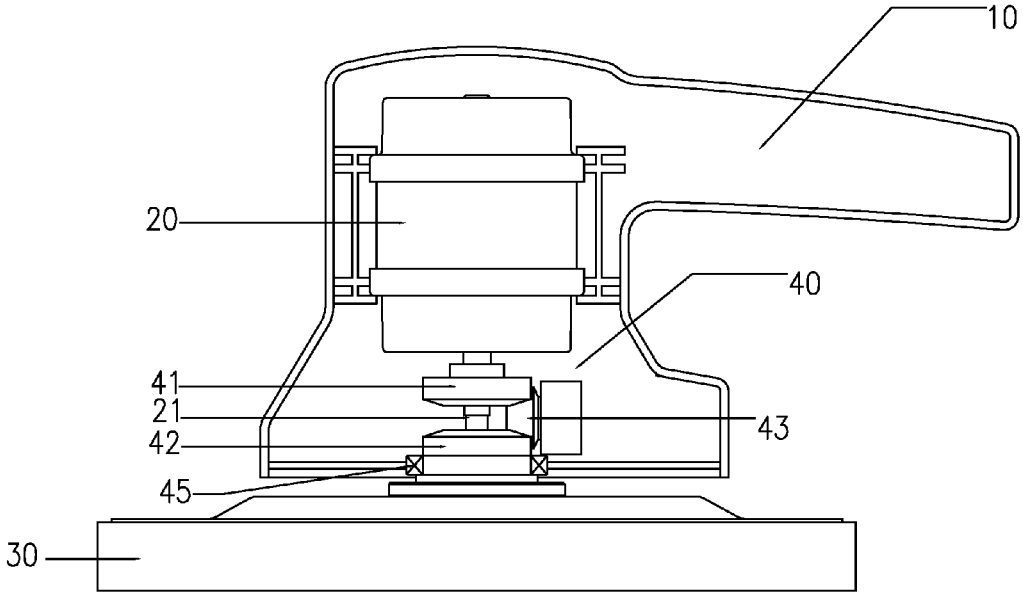
FIG. 3 is a side view of an inner structure of the counter-rotating polisher according to a preferred embodiment of the present invention, illustrating connecting with gears.
Figure 4:
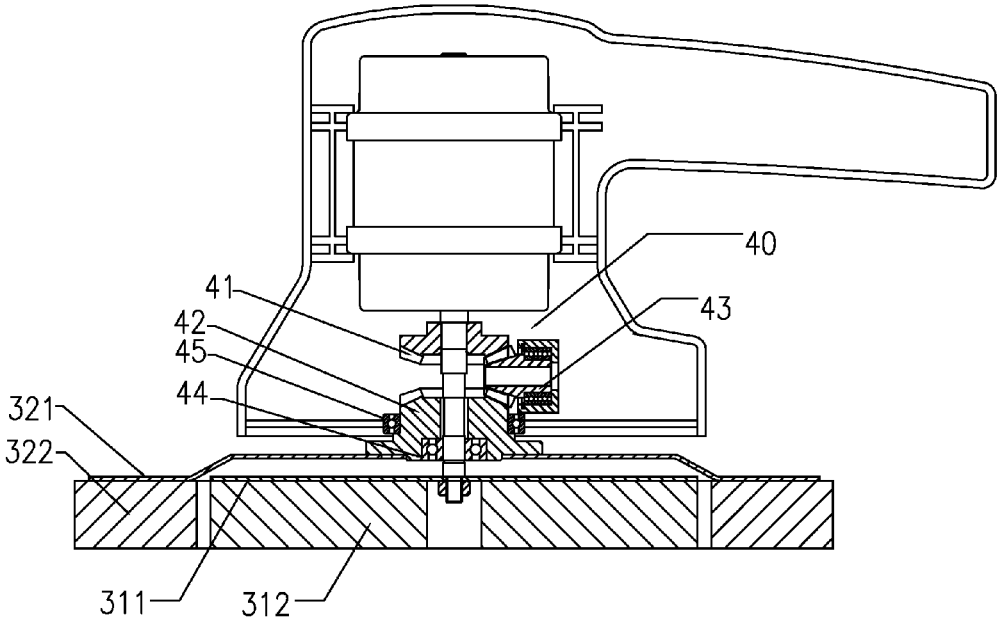
FIG. 4 is a side sectional view of the counter-rotating polisher according to the above preferred embodiment of the present invention, illustrating connecting with gears.

Referring to FIG. 3 to FIG. 4, according to a preferred embodiment of the present invention, the first driving wheel 41 and the second driving wheel 42 are set in parallel and perpendicular to the change-direction wheel 43, and the change-direction wheel 43 is rotatablely mounted on the enclosure 10. The first driving wheel 41 and the second driving wheel 42 are respectively mounted on an upper end and a lower end of the change-direction wheel 43 to connect to the change-direction wheel 43 by wheel teeth, an aim that a rotation of the first driving wheel 41 is reversely transmitted to the second driving wheel 42 is achieved through a theory that the running directions of an upper side and a lower side of the change-direction wheel 43 are opposite.

Figure 5:
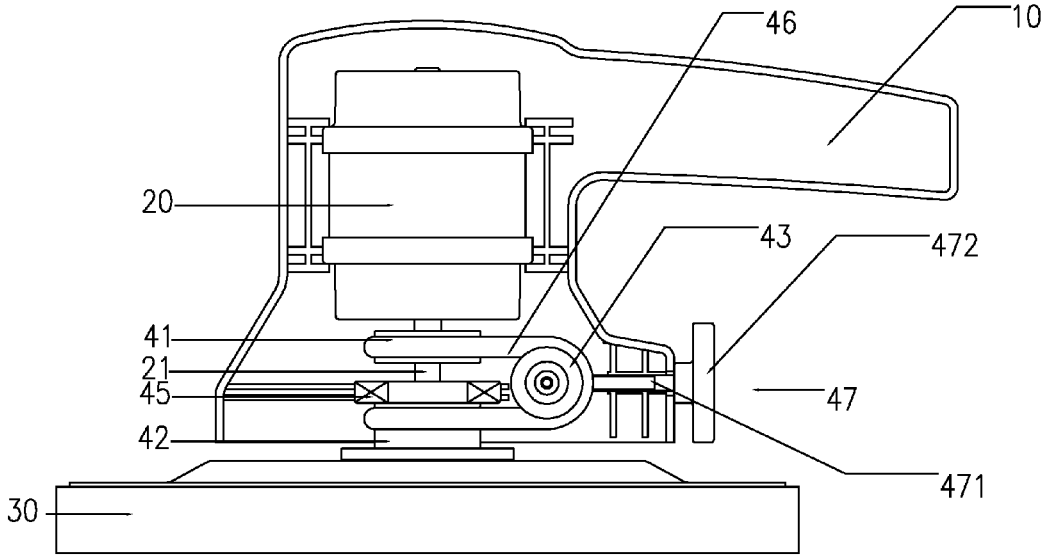
FIG. 5 is a side view of an inner structure of the counter-rotating polisher according to another preferred embodiment of the present invention, illustrating connecting with a belt.
Figure 6:
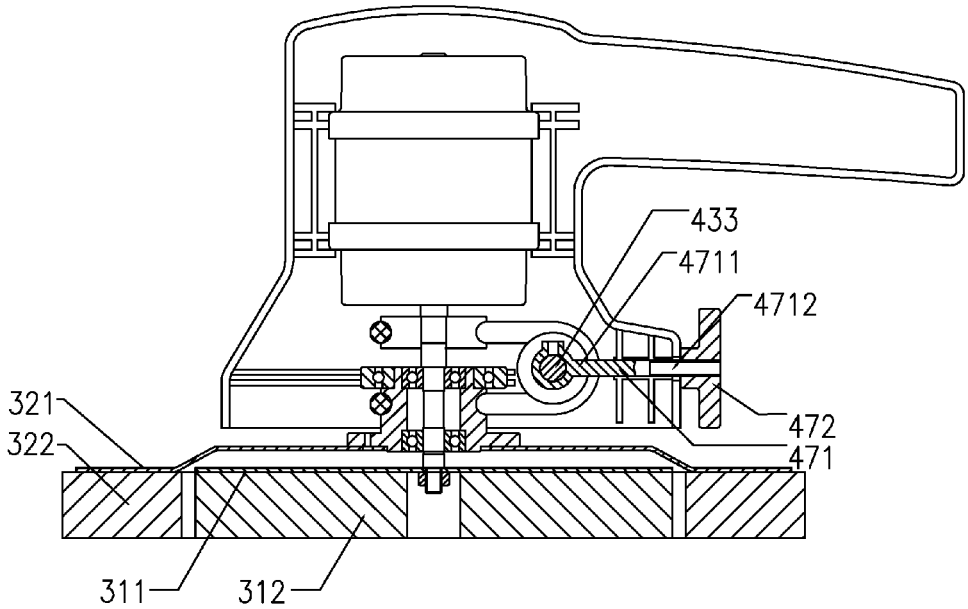
FIG. 6 is a side sectional view of the counter-rotating polisher according to the above preferred embodiment of the present invention, illustrating connecting with a belt.
Figure 7:
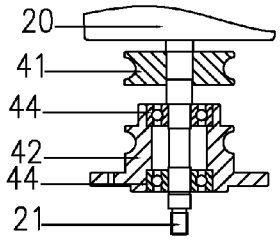
FIG. 7 is a side sectional view of a first driving wheel and a second driving wheel of the counter-rotating polisher according to the above preferred embodiment of the present invention.

Referring to FIG. 5 to FIG. 7, according to another preferred embodiment of the present invention, concretely, the counter-rotating arrangement 40 further comprises a belt 46. The first driving wheel 41 and the second driving wheel 42 are set in parallel and perpendicular to the change-direction wheel 43, and the change-direction wheel 43 is rotatablely mounted on the enclosure 10. The belt 46 is sleeved on the first driving wheel 41, extends to the change-direction wheel 43, extends back to the second driving wheel 42 and is sleeved on the second driving wheel 42 after rounding the change-direction wheel 43 to change a running direction of the belt 46 through the change-direction wheel 43, so that the first driving wheel 41 and the second driving wheel 42 rotate coaxially and oppositely.

To the persons skilled in the art, it's easy to know that because of the electric motor 20 is mounted on the enclosure 10, a same effect would be achieved by connecting the change-direction wheel 43 to the electric motor 20 but not connecting to the enclosure 10, so it is within the scope of the present invention.

Figure 8:
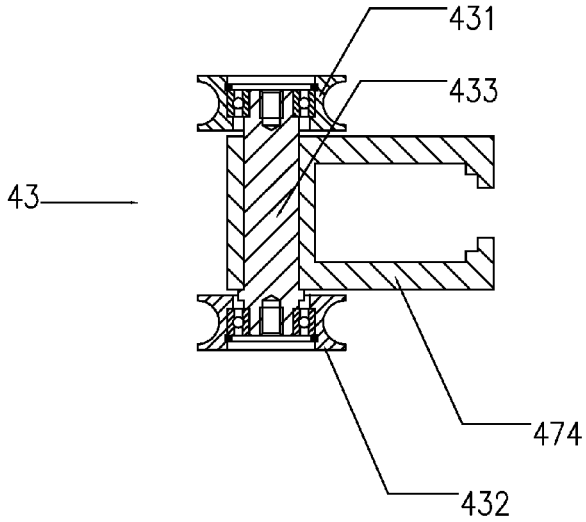
FIG. 8 is a top sectional view of a change-direction wheel of the counter-rotating polisher according to the above preferred embodiment of the present invention.

Referring to FIG. 8, concretely, the change-direction wheel 43 comprises a first part 431 and a second part 432. The first part 431 and the second part 432 rotate coaxially and oppositely. The first part 431 and the second part 432 are respectively positioned on two sides of the first driving wheel 41 and the second driving wheel 42 to take over the belt 46 which is extended to the two sides to rotate oppositely under the rotation of the first driving wheel 41, so the rotation is reversely transmitted to the second driving wheel 42.

According to preferred embodiments of the present invention, the first part 431 and the second part 432 are embodied as two wheels that pass through the same rotating axle 433, and the rotating axle 433 is fixed to the enclosure 10; or the first part 431 comprises a projecting rotating axle 433, and the second part 432 is sleeved on the rotating axle 433 of the first part 431 to rotate oppositely. Persons skilled in the art will think of the other similar structures easily, and the other similar structures should not be seemed to break away from the scope of the present invention.

According to a preferred embodiment of the present invention, a diameter of the change-direction wheel 43 is equal to a distance between the first driving wheel 41 and the second driving wheel 42, the first driving wheel 41 and the second driving wheel 42 are respectively perpendicular to the upper end and the lower end of the change-direction wheel 43 to make a part of the belt 46 which is extended from the first driving wheel 41 to the change-direction wheel 43 and another part of the belt 46 which is extended from the change-direction wheel 43 to the second driving wheel 42 in parallel, a running direction of the belt 46 and the rotation directions of the first driving wheel 41 and the second driving wheel 42 are in a line. With the foregoing structure, the belt 46 is sleeved steadily on the first driving wheel 41 and the second driving wheel 42 to avoid unnecessary rub, an efficiency of transmission is increased, the working life is prolonged.

Figure 10:
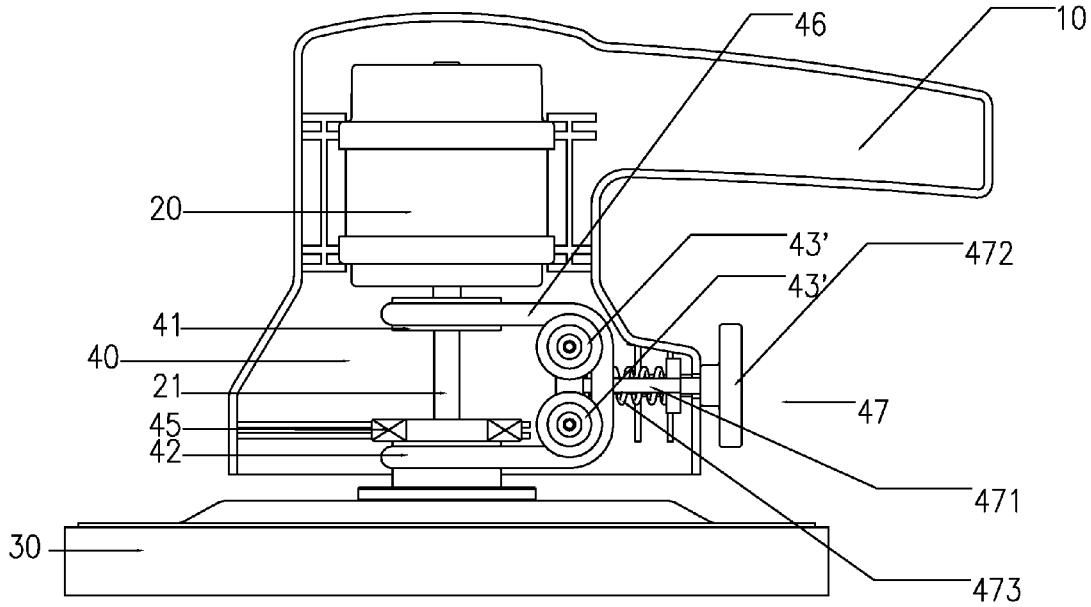
FIG. 10 is a side view of an inner structure of the counter-rotating polisher according to another preferred embodiment of the present invention.

Referring to FIG. 10, according to another preferred embodiment of the present invention, the counter-rotating arrangement 40 comprises two change-direction wheels 43', the first driving wheel 41 and the second driving wheel 42 are set in parallel, the two change-direction wheel 43' are set side by side, respectively perpendicular to and aligned with the first driving wheel 41 and the second driving wheel 42, so that the part of the belt 46 which is extended from the first driving wheel 41 to the change-direction wheel 43' and the another part of the belt 46 which is extended from the change-direction wheel 43' to the second driving wheel 42 in parallel.

According to a preferred embodiment of the present invention, the counter-rotating arrangement 40 further comprises an adjusting unit 47. The enclosure 10 has a through-hole 11, wherein the adjusting unit 47 comprises an adjusting lever 471 mounted on the enclosure 10 through the through-hole 11, the adjusting lever 471 has an inner end 4711 which is connected to the change-direction wheel 43, the adjusting lever 471 is able to move from the first driving wheel 41 to the change-direction wheel 43 along the belt 46 to adjust a tightness degree of the belt 46 through changing a distance between the change-direction wheel 43 and the first driving wheel 41 and the second driving wheel 42. With the foregoing structure, the belt 46 is tightened when becoming loose in using, so that the transmission effect of the counter-rotating arrangement 40 is assured, the working life of the counter-rotating polisher is prolonged, meanwhile, the enclosure 10 is not needed to be opened in the adjusting operation, which is easy to operate and cheap in cost.

Concretely, the adjusting unit 47 further comprises an adjusting knob 472 mounted on the enclosure 10. The adjusting lever 471 has an outer end 4712 connected to the adjusting knob 472 via a screw thread, when one screws the adjusting knob 472, the degree of tightness of the belt 46 will be adjusted through adjusting a position of the adjusting lever 471.

Concretely, according to preferred embodiments of the present invention, the connecting types of the adjusting lever 471 and the rotating axle 433 can be embodied that the inner end 4711 of the adjusting lever 471 is fixedly connected to the rotating axle 433, the first part 431 and the second part 432 are respectively rotate coaxially and oppositely with respect to the rotating axle 433, or the rotating axle 433 is received in the inner end 4711 of the adjusting lever 471 through a bearing and rotates relatively.

Figure 9:
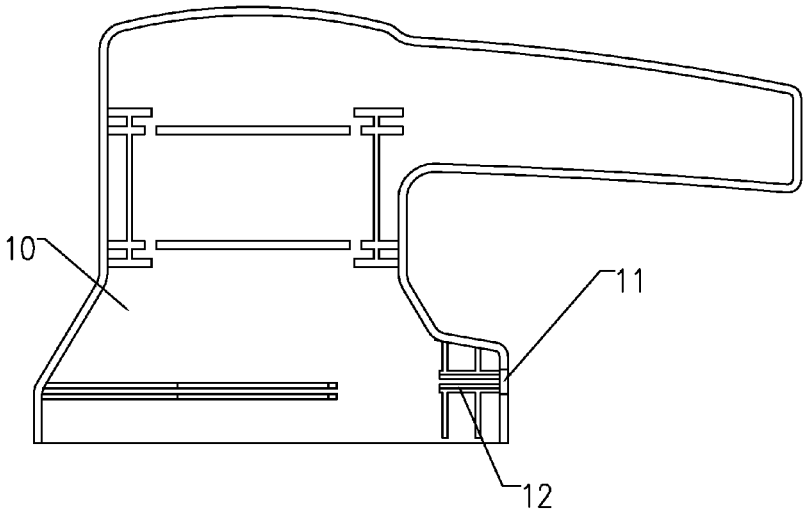
FIG. 9 is a side view of an enclosure of the counter-rotating polisher according to the above preferred embodiment of the present invention.

Referring to FIG. 9, further more, in the above connecting type that the adjusting lever 471 is fixedly connected to the rotating axle 433, the enclosure 10 has two sliding grooves 12 provided along a moving direction of the adjusting lever 471, two ends of the rotating axle 433 are respectively received in the two sliding grooves 12 to move along the two sliding grooves 12 when adjusting the belt 46 to increase a stability of the adjusting unit 47.

According to another preferred embodiment of the present invention, the adjusting unit 47 further comprises a support frame 474 and an adjusting spring 473, the support frame 474 is mounted on the adjusting lever 471, is able to slide along the adjusting lever 471, and is fixedly connected to the change-direction wheel 43, preferably, is fixedly connected to the rotating axle 433. The adjusting spring 473 is mounted on the adjusting lever 471 and compressed between the support frame 474 and the inner end 4711 of the adjusting lever 471. With the foregoing structure, when the adjusting lever 471 is positioned in a particular position, the adjusting spring 473 acts on the support frame 474 and pushes off the support frame 474 from the inner end 4711 of the adjusting lever 471 to tighten the belt 46. The adjusting spring 473 is able to adjust the degree of tightness of the belt 46 within a predetermined range, even the belt 46 becomes loose by using.

According to another preferred embodiment of the present invention, the adjusting unit 47 comprises an adjusting spring 473 mounted between the enclosure 10 and the change-direction wheel 43. The adjusting spring 473 is stretched from the first driving wheel 41 to the change-direction wheel 43 along the belt 46, and creates a force to pull the change-direction wheel 43 away from the first driving wheel 41 and the second driving wheel 42 to tighten the belt 46. The enclosure 10 has two sliding grooves 12 provided along a stretching direction of the adjusting spring 473, the two ends of the rotating axle 433 are respectively received in the two sliding grooves 12 to move along the two sliding grooves 12 when adjusting the belt 46 to increase a stability of the adjusting unit 47.

To the persons skilled in the art, it's easy to think of that the adjusting spring 473 adopts a similar structure with the support frame 474, without using the adjusting lever 471, the effect of adjusting the belt 46 can also be achieved by compressing the adjusting spring 473 instead of stretching the adjusting spring 473.

It will thus be seen that the objects of the present invention have been fully and effectively accomplished. Its embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein said counter-rotating arrangement further comprises a belt, said first driving wheel and said second driving wheel are set in parallel and perpendicular to said change-direction wheel, said change-direction wheel is rotatablely mounted on said enclosure, said belt is sleeved on said first driving wheel, extends to said change-direction wheel, extends back to said second driving wheel and is sleeved on said second driving wheel after rounding said change-direction wheel to change a running direction of said belt through said change-direction wheel, so that said first driving wheel and said second driving wheel rotate coaxially and oppositely.

2. The counter-rotating polisher, as recited in claim 1, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely.

3. The counter-rotating polisher, as recited in claim 1, wherein said counter-rotating arrangement further comprises a reinforced bearing, which is mounted between said driving wheel and said enclosure to make said second driving wheel run smoothly and increase a rigidity of said driving axle of said electric motor.

4. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein said change-direction wheel comprises a first part and a second part which rotate coaxially and oppositely, said first part and said second part are respectively positioned on two sides of said first driving wheel and said second driving wheel to respectively take over a belt which is extended to said two sides for creating opposite rotation through the rotation of said first driving wheel, so the rotation is reversely transmitted to said second driving wheel.

5. The counter-rotating polisher, as recited in claim 4, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely.

6. The counter-rotating polisher, as recited in claim 4, wherein said counter-rotating arrangement further comprises a reinforced bearing, which is mounted between said driving wheel and said enclosure to make said second driving wheel run smoothly and increase a rigidity of said driving axle of said electric motor.

7. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein a diameter of said change-direction wheel is equal to a distance between said first driving wheel and said second driving wheel, said first driving wheel and said second driving wheel are respectively perpendicular to said upper end and said lower end of said change-direction wheel to make a part of a belt which is extended from said first driving wheel to said change-direction wheel and another part of said belt which is extended from said change-direction wheel to said second driving wheel in parallel, a running direction of said belt and the rotation directions of said first driving wheel and said second driving wheel are in a line.

8. The counter-rotating polisher, as recited in claim 7, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely.

9. The counter-rotating polisher, as recited in claim 7, wherein said counter-rotating arrangement further comprises a reinforced bearing, which is mounted between said driving wheel and said enclosure to make said second driving wheel run smoothly and increase a rigidity of said driving axle of said electric motor.

10. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein said counter-rotating arrangement comprises two change-direction wheels, said first driving wheel and said second driving wheel are set in parallel, said two change-direction wheel are set side by side, respectively perpendicular and aligned with said first driving wheel and said second driving wheel, so that said part of a belt which is extended from said first driving wheel to said change-direction wheel and another part of said belt which is extended from said change-direction wheel to said second driving wheel in parallel.

11. The counter-rotating polisher, as recited in claim 10, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely.

12. The counter-rotating polisher, as recited in claim 10, wherein said counter-rotating arrangement further comprises a reinforced bearing, which is mounted between said driving wheel and said enclosure to make said second driving wheel run smoothly and increase a rigidity of said driving axle of said electric motor.

13. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein said counter-rotating arrangement further comprises an adjusting unit, said enclosure has a through-hole, wherein said adjusting unit comprises an adjusting lever mounted on said enclosure through said through-hole, said adjusting lever has an inner end which is connected to said change-direction wheel, said adjusting lever is able to move from said first driving wheel to said change-direction wheel along a belt to adjust a tightness degree of said belt through changing a distance between said change-direction wheel and said first driving wheel and said second driving wheel.

14. The counter-rotating polisher, as recited in claim 13, wherein said adjusting unit further comprises an adjusting knob mounted on said enclosure, said adjusting lever has an outer end, said outer end is connected to said adjusting knob via a screw thread, when one screws said adjusting knob, the degree of tightness of said belt will be adjusted through adjusting a position of said adjusting lever.

15. The counter-rotating polisher, as recited in claim 13, wherein said inner end of said adjusting lever is fixedly connected to a rotating axle, said first part and said second part are respectively rotate coaxially and oppositely with respect to said rotating axle, said enclosure had two sliding grooves, said two sliding grooves are provided along a moving direction of said adjusting lever, two ends of said rotating axle are respectively contained in said two sliding grooves to move along said two sliding grooves when adjusting said belt to increase a stability of said adjusting unit.

16. The counter-rotating polisher, as recited in claim 13, wherein said adjusting unit further comprises: an adjusting spring mounted on said adjusting lever; a support frame, mounted on said adjusting lever, capable of sliding along said adjusting lever and fixedly connected to said change-direction wheel, wherein said adjusting spring is compressed between said support frame and said inner end of said adjusting lever, said adjusting spring acts on said support frame and pushes off said support frame from said inner end of said adjusting lever to tighten said belt, said adjusting spring is capable of adjusting the degree of tightness of said belt within a predetermined range, even said belt becomes loose by using.

17. The counter-rotating polisher, as recited in claim 13, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely.

18. The counter-rotating polisher, as recited in claim 13, wherein said counter-rotating arrangement further comprises a reinforced bearing, which is mounted between said driving wheel and said enclosure to make said second driving wheel run smoothly and increase a rigidity of said driving axle of said electric motor.

19. A counter-rotating polisher, comprising:

an enclosure;

an electric motor, fixed inside said enclosure, and comprising a driving axle;

a polishing arrangement, driven by said electric motor, comprising a first polishing device, comprising a first fixed tray perpendicular to said driving axle and a first polishing material fixedly connected to an outer wall of said first fixed tray, and a second polishing device, comprising a second fixed tray perpendicular to said driving axle and a second polishing material fixedly connected to an outer wall of said second fixed tray, wherein a polishing surface of said first polishing material and a polishing surface of second polishing material are on a same plane and rotate coaxially and oppositely; and a counter-rotating arrangement, comprising a first driving wheel connected to said driving axle and driven by said driving axle, a second driving wheel fixedly connected to said second fixed tray, and a change-direction wheel connected to said first driving wheel and said second driving wheel, wherein said first fixed tray is connected to said driving axle and driven by said driving axle to rotate said first polishing material positively, said change-direction wheel reversely transmits a rotation of said first driving wheel to said second driving wheel to rotate said second polishing material oppositely, wherein said counter-rotating arrangement further comprises an adjusting unit, said enclosure has a through-hole, wherein said adjusting unit further comprises an adjusting spring, said adjusting spring is mounted between said enclosure and said change-direction wheel, said adjusting spring is stretched from said first driving wheel to said change-direction wheel along a belt, and creates a force to pull said change-direction wheel away from said first driving wheel and said second driving wheel to tighten said belt, said enclosure has two sliding grooves provided along a stretching direction of said adjusting spring, said two ends of said rotating axle are respectively received in said two sliding grooves to move along said two sliding grooves when adjusting said belt to increase a stability of said adjusting unit.

20. The counter-rotating polisher, as recited in claim 19, wherein said counter-rotating arrangement further comprises a bearing, said first fixed tray is fixed directly to said driving axle, said bearing is sleeved on said driving axle, said second driving wheel is connected to said bearing, in such a manner that said second driving wheel does not rotate along with said driving axle directly to make said first fixed tray and said second fixed tray rotate coaxially and oppositely, wherein said counter-rotating arrangement further comprises a reinforced bearing, which is mounted between said driving wheel and said enclosure to make said second driving wheel run smoothly and increase a rigidity of said driving axle of said electric motor.

* * * * *